US011619246B1

(12) United States Patent
O'Rorke

(10) Patent No.: US 11,619,246 B1
(45) Date of Patent: Apr. 4, 2023

(54) FAIL-FIXED HYDRAULIC ACTUATOR

(71) Applicant: Hamilton Sundstrand Corporation, Charlotte, NC (US)

(72) Inventor: Morgan O'Rorke, West Hartford, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 17/728,283

(22) Filed: Apr. 25, 2022

(51) Int. Cl.

| | |
|---|---|
| ***F15B 11/12*** | (2006.01) |
| ***F15B 15/14*** | (2006.01) |
| ***F15B 15/08*** | (2006.01) |
| ***F15B 15/22*** | (2006.01) |
| ***F15B 19/00*** | (2006.01) |

(52) U.S. Cl.
CPC ..... *F15B 19/005* (2013.01); *F15B 11/12* (2013.01); *F15B 15/088* (2013.01); *F15B 15/1471* (2013.01); *F15B 15/1476* (2013.01); *F15B 15/224* (2013.01); *F15B 2211/7653* (2013.01)

(58) Field of Classification Search
CPC .... F15B 11/12; F15B 15/088; F15B 15/1471; F15B 15/1476; F15B 15/224; F15B 2211/7653
See application file for complete search history.

(56) References Cited

U.S. PATENT DOCUMENTS 4,745,815 A * 5/1988 Klopfenstein ..... B64C 13/38 74/89.25
4,876,906 A * 10/1989 Jones ..... B64C 13/504 74/89.25
5,551,478 A 9/1996 Veilleuxjr et al.
5,735,122 A 4/1998 Gibbons
7,059,418 B2 6/2006 Greeb et al.
7,475,537 B2 1/2009 Spickard
7,836,676 B2 11/2010 Futa, Jr. et al.
10,619,654 B2 4/2020 Haugsjaahabink
11,242,875 B2 2/2022 Futa et al.
(Continued)

FOREIGN PATENT DOCUMENTS

DE 102016105193 A1 * 9/2017 ..... B64C 13/40

OTHER PUBLICATIONS

DE-102016105193-A1 machine translation (Year: 2017).*

*Primary Examiner* — Kenneth Bomberg
*Assistant Examiner* — Matthew Wiblin
(74) *Attorney, Agent, or Firm* — Cantor Colburn LLP

(57) ABSTRACT

Fail-fixed hydraulic actuator systems for aircraft include a hydraulic actuator having a piston in a housing. The piston separates the housing into a retract cavity and an extend cavity. A sleeve is moveably arranged within the housing and includes a sleeve aperture that is aligned with a piston head during normal operation. A driving mechanism is configured to drive movement of the sleeve to maintain alignment between the sleeve aperture and the piston head. A low pressure cavity is defined between an interior surface of the housing and the sleeve and, when the piston head is offset from the sleeve aperture, the low pressure cavity is hydraulically connected to one of the retract cavity or the extend cavity to cause a pressure differential with the other of the extend cavity and the retract cavity and cause movement of the piston head to align with the sleeve aperture.

16 Claims, 3 Drawing Sheets

(56) References Cited

U.S. PATENT DOCUMENTS

| | | | | |
|---|---|---|---|---|
| 2015/0184681 | A1* | 7/2015 | Ogawa | F15B 15/224 92/82 |
| 2016/0333901 | A1 | 11/2016 | Dalton | |
| 2017/0023031 | A1* | 1/2017 | Wildman | F15B 15/088 |
| 2018/0320715 | A1 | 11/2018 | Haugsjaahabink | |
| 2021/0317851 | A1 | 10/2021 | Portolese et al. | |

* cited by examiner

FAIL-FIXED HYDRAULIC ACTUATOR

BACKGROUND

The following description relates to hydraulic actuators and, more particularly, to a fail-fixed hydraulic actuator system that employ a motor to adjust a position of a sleeve within the actuator system to define a fail-position of a piston of the system.

In many engine actuator applications, an actuator is sent into or positioned in a fail-safe position in an even of an electrical failure. This fail-safe position may be an extended or retracted position. In helicopters, however, the notion of automatically positioning an actuator in a fail-safe position instead of a last-commanded position in the event of an electrical failure might not be desirable because of a need to maintain certain flight control parameters. Indeed, in at least some cases, while it is actually desirable to hold the actuator in the last commanded position instead of the fail-safe position in the event of an electrical failure, the nature of control systems of typical hydraulically powered actuators of helicopters makes doing so difficult. Accordingly, improved fail-safe position actuator are desirable.

BRIEF DESCRIPTION

According to some aspects of the present disclosure, fail-fixed hydraulic actuator systems for aircraft are provided. The fail-fixed hydraulic actuator systems include a hydraulic actuator having a housing with a piston arranged within the housing, the piston having a piston head separating the housing into a retract cavity and an extend cavity, a sleeve arranged within the housing and movable therein, the sleeve having a sleeve aperture that is aligned with the piston head during normal operation, and a driving mechanism configured to drive movement of the sleeve to maintain alignment between the sleeve aperture and the piston head. A low pressure cavity is defined between an interior surface of the housing and the sleeve, and, when the piston head is offset from the sleeve aperture, the low pressure cavity is hydraulically connected to one of the retract cavity or the extend cavity to cause a pressure differential with the other of the extend cavity and the retract cavity and cause movement of the piston head to align with the sleeve aperture.

In accordance with additional or alternative embodiments, the fail-fixed hydraulic actuator systems may include a controller configured to control operation of the drive mechanism.

In accordance with additional or alternative embodiments, the fail-fixed hydraulic actuator systems may include that the controller is integrated into the drive mechanism.

In accordance with additional or alternative embodiments, the fail-fixed hydraulic actuator systems may include a position sensor configured to detect a position of at least one of the piston and the piston head within the housing, wherein the position sensor is configured in communication with the controller.

In accordance with additional or alternative embodiments, the fail-fixed hydraulic actuator systems may include a position sensor configured to detect a position of at least one of the piston and the piston head within the housing.

In accordance with additional or alternative embodiments, the fail-fixed hydraulic actuator systems may include that the driving mechanism is an electric motor.

In accordance with additional or alternative embodiments, the fail-fixed hydraulic actuator systems may include at least one seal configured to sealing engage the sleeve with the housing and define the low pressure cavity.

In accordance with additional or alternative embodiments, the fail-fixed hydraulic actuator systems may include a first high pressure source hydraulically coupled to the retract cavity, a second high pressure source hydraulically coupled to the extend cavity, and a low pressure source hydraulically coupled to the low pressure cavity, wherein a pressure of the first and second high pressure sources is greater than a pressure of the low pressure source.

In accordance with additional or alternative embodiments, the fail-fixed hydraulic actuator systems may include an aircraft system, wherein the piston is configured to actuate a component of the aircraft system.

According to some embodiments, methods of operating fail-fixed hydraulic actuator systems onboard aircraft are provided. The methods include operating an actuator to perform an actuating operation, moving a sleeve within the actuator to maintain alignment between a piston head within the actuator and a sleeve aperture of the sleeve, hydraulically connecting a low pressure cavity defined by the sleeve to one of a retract cavity or an extend cavity of the actuator when the piston head is offset from the aperture sleeve, and moving the piston head into alignment with the sleeve aperture in response to the connection between the low pressure cavity and the one of the retract cavity or the extend cavity.

In accordance with additional or alternative embodiments, the methods may include monitoring a position of at least one of the piston head or the piston within a housing of the actuator.

In accordance with additional or alternative embodiments, the methods may include that moving of the sleeve is controlled by a drive mechanism operably coupled thereto.

In accordance with additional or alternative embodiments, the methods may include detecting a position of piston head within the actuator and controlling the position of the sleeve aperture to maintain alignment of the sleeve aperture and the piston head in response to the detected position.

In accordance with additional or alternative embodiments, the methods may include that movement of the piston head to align with the sleeve aperture is in response to a power failure of the actuator.

In accordance with additional or alternative embodiments, the methods may include that the low pressure cavity has a lower pressure than a pressure of the retract cavity or the extend cavity.

In accordance with additional or alternative embodiments, the methods may include supplying the retract cavity with a high pressure from a first high pressure source, supplying the extend cavity with a high pressure from a second high pressure source, and supplying the low pressure cavity with a low pressure from a low pressure source. The low pressure is less than the pressure of either of the first and second high pressure sources.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

DETAILED DESCRIPTION

As will be described below, a system and method are provided to allow for tight control of a fail-fixed position in a hydraulically controlled actuator. Hydraulic actuation systems are useful for high load and slew rate capabilities, but such actuators may tend to revert to an extend or retract stop point at a time of failure, even if the piston of the actuator is not at an end position. That is, in a failure condition, conventional actuators may be biased to one end-stop (e.g., fully retracted or fully extended). However, it may be desirable to have an actuator that remains in a last commanded position despite a failure. That is, it may be beneficial to have an actuator that remains in a current position rather than fully extending or fully retracting at a time of failure. Such failures may be the result of power loss, control loop failure, or the like.

Figure 1A:
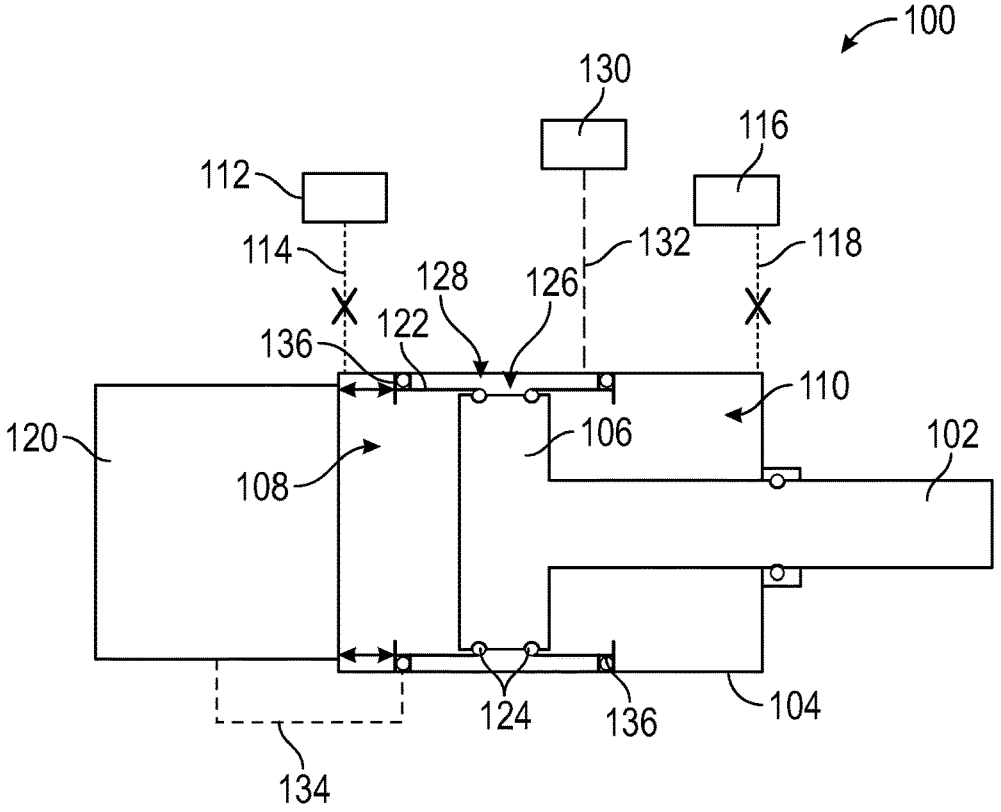
FIG. 1A is a schematic illustration of an actuator system in accordance with an embodiment of the present disclosure, showing alignment of a piston head and a sleeve aperture.
Figure 1B:
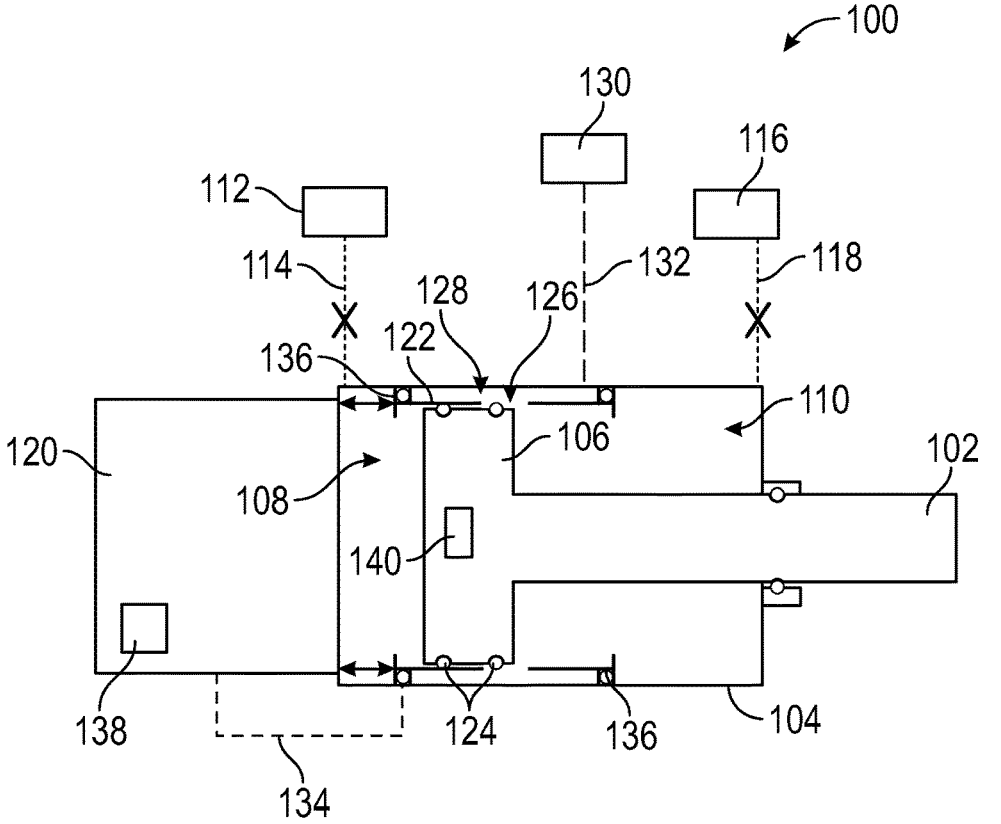
FIG. 1B is a schematic illustration of the actuator system of FIG. 1A, showing offset of the piston head from the sleeve aperture.

Referring to FIGS. 1A-1B, schematic illustrations of a fail-fixed position actuator system 100 in accordance with an embodiment of the present disclosure are shown. The fail-fixed position actuator system 100 may be used onboard aircraft to perform an actuating operation through actuation or movement of a piston 102 within a housing 104. The piston 102 includes a piston head 106 that is configured to have hydraulic pressure applied thereto such that the piston head 106 translates or otherwise moves within the housing 104. The housing 104 defines a retract cavity 108 and an extend cavity 110 which are defined on opposite sides of the piston head 106.

To cause movement of the piston 102 relative to the housing 104, the retract cavity 108 and the extend cavity are each hydraulically (and/or fluidly) coupled to respective pressure sources which can be controlled to increase or decrease a pressure within the cavities 108, 110. For example, the retract cavity 108 may be coupled (hydraulically and/or fluidly) to a first high pressure source 112 by a first high pressure line 114. Similarly, the extend cavity 110 may be coupled (hydraulically and/or fluidly) to a second high pressure source 116 by a second high pressure line 118.

In a normal state of operation, high pressure fills both the retract cavity 108 and the extend cavity 110. It is noted that pressure in either cavity may not necessarily be equal, and that the pressures will be what is needed to maintain the actuator in force balance. The pressure levels of the two cavities 108, 110 may be adjusted or controlled to control operation and actuation of the piston 102. In accordance with embodiments of the present disclosure, an electric motor 120 is configured to translate a windowed sleeve 122 axially to a desired actuator position. The electric motor 120 may be coupled to or attached to the housing 104 or may be arranged in proximity to the housing 104. The electric motor 120 may be operably coupled to the sleeve 122 to control movement of the sleeve 122 within the housing 104. That is, the sleeve 122 is arranged within the housing 104 and is positioned such that the piston head 106 may slidingly and sealingly engage with the sleeve 122. During normal operation, the sleeve 122 may be moved with the piston 102 such that the piston head 106 remains in sealing engagement with the sleeve 122 (shown in FIG. 1A). For example, as the pressure in the extend cavity 110 is decreased and the pressure in the retract cavity 108 is increased, the piston 102 will perform an extension actuation (e.g., to the right on the page). As the piston head 106 moves with the piston 102 during the extension, the motor 120 will drive movement of the sleeve 122 such that the sleeve 122 moves with the piston head 106. The piston head 106 includes one or more seals 124.

As noted, the sleeve 122 is a windowed sleeve, including a sleeve aperture 126. In the normal position (FIG. 1A), the piston head 106 is aligned with the sleeve aperture 126 and is sealingly engaged with the sleeve 122 by the seals 124. When in this position, a low pressure cavity 128 is defined between the piston head 106 and the sleeve 122 on a first side and a portion of the housing 104 on a second side. The low pressure cavity 128 is hydraulically and/or fluidly connected to a low pressure source 130 by a low pressure line 132. As such, during normal operation, the low pressure cavity 128 is filled with low pressure fluid, and the two cavities 108, 110 are filled with high pressure fluid.

The motor 120 may be operated to control the position of the sleeve 122 and particularly the sleeve aperture 126 within the housing 104. If the piston head 106 is moved away from the sleeve aperture 126, the low pressure cavity 128 will be exposed to and fluidly connected to either the retract cavity 108 or the extend cavity 110. When the low pressure cavity 128 is in fluid communication with one of the cavities 108, 110, the pressure within that cavity 108, 110 will be decreased and the pressure on the other side of the piston head 106 will be relatively higher. This pressure differential across the piston head 106 will cause the piston head 106 to move toward the lower pressure side and thus the piston head 106 may be aligned again with the sleeve aperture 126. That is, when the piston head 106 is moved to cover the sleeve aperture 126, the forces on opposing sides of the piston head 106 may be equalized and ensure that the piston 102 is held in a desired position.

Stated another way, when the piston 102 is not at a desired position, the position may be corrected through the positioning of the sleeve 122 within the housing 104. For example, the sleeve 122 may be moved (by operation of the motor 12) to position the sleeve aperture 126 at a location that is desired for the piston head 106 to be located. Then, when the piston head 106 is moved, such as due to an external load application to the piston 102, the sleeve aperture 126 will be exposed to one of the actuator cavities (i.e., the retract cavity 108 or the extend cavity 110) to low pressure. This exposure to low pressure will cause a pressure differential and the piston head 106 will be caused to move until the sleeve aperture 126 is covered by the piston head 106 and the associated seals 124.

The motor 120 may be operably coupled to the sleeve 122 and configured to control movement of the sleeve 122 within the housing 104 through a control connection 134. The control connection 134 may be a drive shaft, induction coil, magnetic system or the like that is configured to cause movement of the sleeve 122 within the housing 104. In some non-limiting examples, a linear motor and worm gear may be configured to drive the position of the sleeve 122. The motor 120 may be an electric motor that is supplied with electrical power from other sources onboard an aircraft, as will be appreciated by those of skill in the art. The motor 120 is configured to control the position of the sleeve 122 within the housing 104 and specifically the location of the sleeve aperture 126. The sleeve aperture 126 defines the position that the piston head 106 should be located in a force balance between the retract cavity 108 and the extend cavity 110. As such, if the piston head 106 is not located at the appropriate position, the exposure of the low pressure cavity 128 to one of the retract cavity 108 or the extend cavity 110 will cause movement of the piston head 106 such that the sleeve aperture 126 is covered by the piston head 106. As such, load is balanced passively in the event of a failure of the fail-fixed position actuator system 100 (e.g., loss of electrical power). Accordingly, the actuation of the fail-fixed position actuator system 100 may be maintained in a last-issued command position based on the location of the sleeve 122, the sleeve aperture 126, and the piston head 106.

In accordance with embodiments of the present disclosure, a fail-fixed hydraulic actuator is presented containing a windowed sleeve (sleeve aperture) that is translated by a motor (e.g., linear electric motor). Both extend and retract cavities are connected to high pressure via respective orifices to high pressure sources. When moved, the sleeve exposes one of the cavities of the hydraulic actuator to low pressure through the sleeve aperture. This exposure to low pressure causes the actuator to slew until the sleeve aperture is covered (or partially covered) and the actuator is in force balance with an external load (e.g., applied to the piston).

Although FIG. 1B illustrates the low pressure cavity 128 fluidly connected to the extend cavity 110 through the sleeve aperture 126, such configuration is not to be limiting but rather is for illustrative and explanatory purposes. In some instances, the piston head 106 may end on the opposite side of the sleeve aperture 126 such that the retract cavity 108 fluidly couples to the low pressure cavity 128. Accordingly, the fail-fixed position actuator system 100 can provide a fail-fixed position of the piston 102 relative to the housing 104, regardless of the position of the piston head 106 at the time of the failure (e.g., loss of electrical power). The location of the sleeve aperture 126 defines the final fail position of the piston head 106 and thus the piston 102.

As shown, the sleeve 122 is configured to move within the housing 104. The sleeve 122 may sealingly engage with an interior surface of the housing 104 using one or more seals 136. The seals 136 are provided to ensure that there is no fluid or pressure bleed between the low pressure cavity 128 and the high pressure cavities (e.g., retract cavity 108, extend cavity 110) except when the sleeve aperture 126 is exposed to one of the cavities 108, 110.

The motor 120 that drives the position of the sleeve 122 within the housing 104 may include a controller 138 (or may be in communication with a controller external thereto). The controller 138 may be configured to control the movement and position of the sleeve 122 within the housing 104. In some embodiments, and as shown, the piston 102 may include a position sensor 140 that provides information regarding the current position of the piston 102 or piston head 106 within the housing 104. The position sensor 140 may be in communication with the controller 138 such that the controller 138 receives the position information of the piston 102 and controls the position of the sleeve 122 relative thereto. Although shown with the position sensor 140 as part of the piston head 106, such location is not to be limiting. Various types of position sensors may be employed without departing from the scope of the present disclosure. Optical position sensors, proximity sensors, direct coupling to the piston head and/or piston shaft, control data from an actuator controller, or the like may all be used individually and/or in combination to monitor the position of the piston within the housing.

Figure 2:
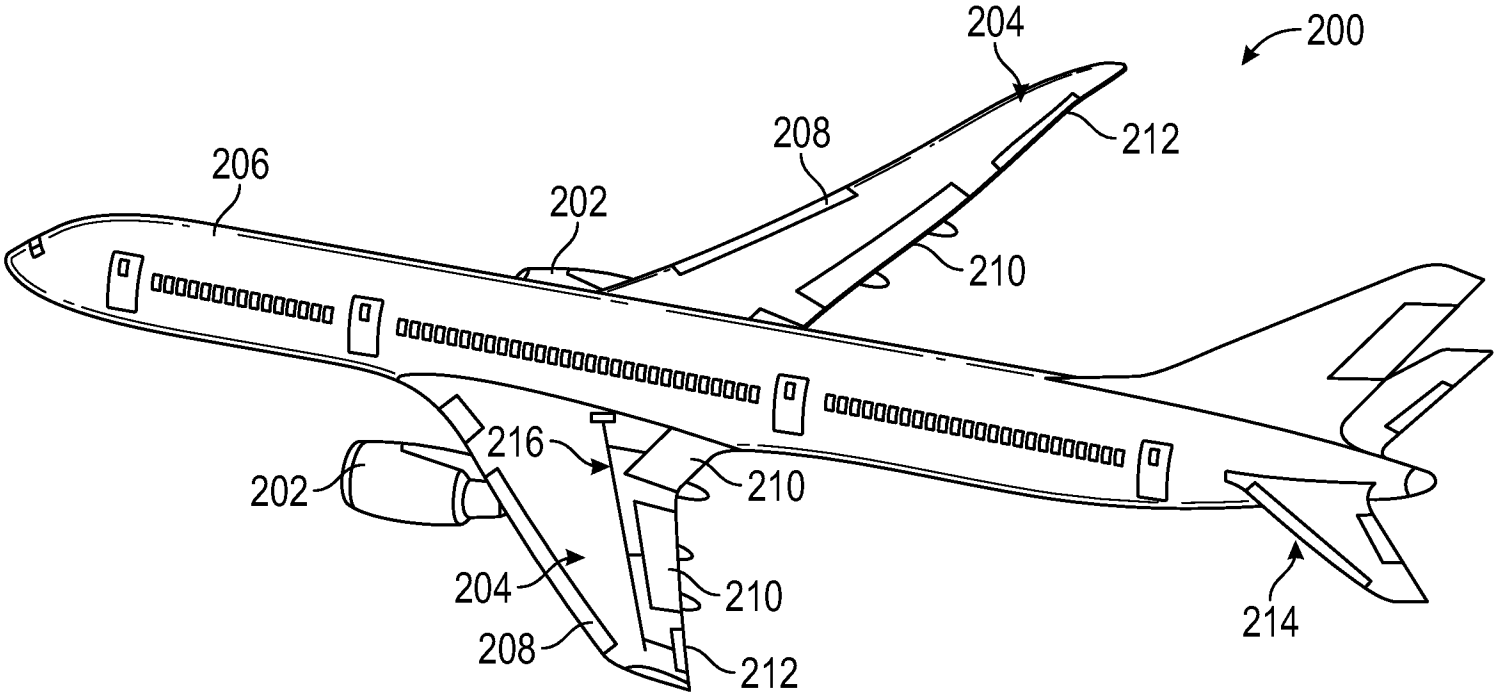
FIG. 2 is a schematic illustration of an aircraft that may incorporate embodiments of the present disclosure.

FIG. 2 illustrates an example of an aircraft 200 having aircraft engines surrounded by (or otherwise carried in) nacelles 202. The aircraft 200 includes wings 204 that extend from an aircraft fuselage 206. Each wing 204 may include one or more slats 208 on a forward edge or leading edge and one or more flaps 210 on an aft, rear, or trailing edge thereof. The wings 204 may also include ailerons 212 on the trailing edges, as will be appreciated by those of skill in the art. The aircraft 200, as shown, includes a tail structure 214 which can include various flaps, ailerons, slats, and the like, as will be appreciated by those of skill in the art. The flaps, slats, ailerons, and the like are generally referred to herein as "aerostructures" as they are movable under aircraft power systems and are configured to control flight and motion of the aircraft 200. An aerostructure actuator system 216 may be connected to one or more of the aerostructures. For example, each wing 204 and the tail structure 214 may include one or more aerostructure actuator systems 216. The aerostructure actuator systems 216 may be operably connected to the various aerostructures and configured control the operation/position of the aerostructures to control flight of the aircraft 200. In some embodiments, the aerostructure actuator systems 216 can include one or more actuator systems such as shown and described above with respect to FIGS. 1A-1B. Further, the engines of the aircraft 200 may include various actuators and control mechanisms that can incorporate one or more actuator systems such as shown and described above with respect to FIGS. 1A-1B. As such, the described actuator systems of the present disclosure may be incorporated into aircraft engine systems and/or aircraft flight systems. It will be appreciated that such actuator systems as described herein may be used for other purposes onboard aircraft, such as for actuating doors, landing gear, or the like.

Figure 3:
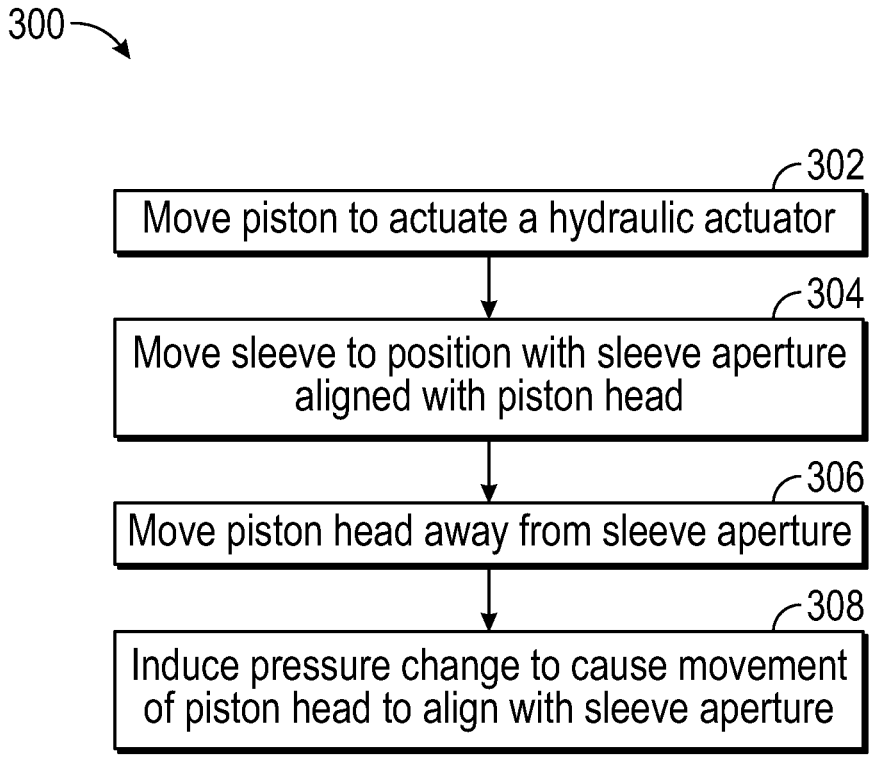
FIG. 3 is a flow process for operation of an actuator system in accordance with an embodiment of the present disclosure.

Turning now to FIG. 3, a flow process 300 for operating an actuator system in accordance with an embodiment of the present disclosure. The flow process 300 is designed for operating an actuator system such as that shown and described above. The flow process 300 may be performed using a controller or the like that is configured to monitor a position of a piston within a housing and also control the position of a sleeve within the housing, through control and operation of a motor or other driving mechanism.

The flow process 300 operation is functional with a hydraulic actuator having a piston actuator arranged within a housing with a sleeve positioned relative to a piston head within the housing. The sleeve includes a sleeve aperture and is drivingly moveable within the housing of the hydraulic actuator by a motor operably connected to the sleeve. The positioning of the sleeve aperture within the housing is controlled to ensure that the piston head is placed where needed in the event of a failure of the actuator system. That is, the positioning of the aperture ensures a fixed end or stop position of the piston head in the event of failure of the system (as compared to ending at a full extension or full retraction).

At block 302, a piston is caused to move within a housing to actuate the hydraulic actuator. The control of the motion of the piston may be achieved through control of hydraulic and/or fluid pressure on opposing sides of the piston head. For example, the piston may be arranged within the housing and an electrohydraulic servo valve may be operably coupled thereto to control fluid and/or hydraulic pressure on opposing sides of a piston head to control actuation of the actuator. In some operations, the piston will slide within a sleeve, as shown and described above, and is applicable for a case where an external load causes the piston (and piston head) to move. Further, in some operations of the actuator, a new actuator position is desired and the flow process will start with positioning the sleeve to a new position, thus exposing the piston head to the force imbalance, as described herein.

At block 304, as the piston is moved within the housing, a motor is operated to control the position of the sleeve within the housing. The movement of the sleeve may be substantially similar to the movement of the piston head within the housing. As such, during normal operation, the sleeve may not impact the operation of the piston in the process of actuating the hydraulic actuator. The movement of the sleeve within the housing is made to ensure that the sleeve aperture is located at a desired location at all times. For example, the position of the sleeve aperture may be moved to ensure that in the event of a failure of the hydraulic aperture that the sleeve aperture is located at a position desired for the piston to stop and stay and hold the piston in the desired position due to force balancing.

At block 306, the piston head is moved away from the sleeve aperture. Such offset of the piston from the sleeve aperture may occur due to a failure of some kind related to the hydraulic actuator. In the event of a failure, the pressures on opposing sides of the piston head may be unbalanced, thus causing the piston head to move toward one end of the housing, and thus offset the piston head from the sleeve aperture.

At block 308, as the piston head is offset from the sleeve aperture, a pressure change is induced in the housing to cause the piston head to move and align with the sleeve aperture. For example, as shown and described above, by moving the piston head away from the sleeve aperture, the sleeve aperture is exposed and thus allows for hydraulic and/or fluid connection between a low pressure cavity of the hydraulic actuator and one of the high pressure cavities thereof. This connection causes a pressure change (decrease) in the high pressure cavity that is connected to the low pressure cavity, thus causing movement of the piston head to realign with the sleeve aperture.

Advantageously, embodiments of the present disclosure provide for improved actuators and fail-fixed position for such actuators. In accordance with embodiments of the present disclosure, upon failure of electrical power, the hydraulic actuator will remain in a last commanded position and will retain an ability to oppose variable external loads. This is achieved through a passive fail-fixed position process that is achieved through a moveable sleeve within the actuator with an aperture or window that, when exposed to a cavity of the actuator, will allow low pressure into the cavity and thus cause movement of the piston to the fail-fixed position. Accordingly, embodiments provided herein provide for a passive failure operation for an actuator to ensure the actuator stays in a last commanded position at the time of failure, whether the piston of the actuator is at an end stop or between ends of the actuator. Further, because the fail-fixed position is maintained by a force balance, after the failure, the actuator may remain in the fixed position and resist or oppose external loads even without a supply of power.

The terms "about" and "substantially" are intended to include the degree of error associated with measurement of the particular quantity based upon the equipment available at the time of filing the application. For example, "about" can include a range of ±8% or 5%, or 2% of a given value.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e., one, two, three, four, etc. The term "a plurality" is understood to include any integer number greater than or equal to two, i.e., two, three, four, five, etc. The term "connection" can include an indirect "connection" and a direct "connection".

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently (or simultaneously), or the blocks may sometimes be executed in the reverse order, depending upon the functionality involved. It is also noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description but is only limited by the scope of the appended claims.

What is claimed is:

1. A fail-fixed hydraulic actuator system of an aircraft, the fail-fixed hydraulic actuator system comprising:

a hydraulic actuator having a housing with a piston arranged within the housing, the piston having a piston head separating the housing into a retract cavity and an extend cavity;

a sleeve arranged within the housing and movable therein, the sleeve having a sleeve aperture that is aligned with the piston head during normal operation; and a motor to drive movement of the sleeve to maintain alignment between the sleeve aperture and the piston head, wherein a low pressure cavity is defined between an interior surface of the housing and the sleeve, and wherein when the piston head is offset from the sleeve aperture the low pressure cavity is hydraulically connected to one of the retract cavity or the extend cavity to cause a pressure differential with the other of the extend cavity and the retract cavity and cause movement of the piston head to align with the sleeve aperture.

2. The fail-fixed hydraulic actuator system of claim 1, further comprising a controller configured to control operation of the motor.

3. The fail-fixed hydraulic actuator system of claim 2, wherein the controller is integrated into the motor.

4. The fail-fixed hydraulic actuator system of claim 2, further comprising a position sensor configured to detect a position of at least one of the piston and the piston head within the housing, wherein the position sensor is configured in communication with the controller.

5. The fail-fixed hydraulic actuator system of claim 1, further comprising a position sensor configured to detect a position of at least one of the piston and the piston head within the housing.

6. The fail-fixed hydraulic actuator system of claim 1, wherein the motor is an electric motor.

7. The fail-fixed hydraulic actuator system of claim 1, further comprising at least one seal configured to sealing engage the sleeve with the housing and define the low pressure cavity.

8. The fail-fixed hydraulic actuator system of claim 1, further comprising a first high pressure source hydraulically coupled to the retract cavity, a second high pressure source hydraulically coupled to the extend cavity, and a low pressure source hydraulically coupled to the low pressure cavity, wherein a pressure of the first and second high pressure sources is greater than a pressure of the low pressure source.

9. The fail-fixed hydraulic actuator system of claim 1, further comprising an aircraft system, wherein the piston is configured to actuate a component of the aircraft system.

10. A method of operating a fail-fixed hydraulic actuator system onboard an aircraft, the method comprising:

operating an actuator to perform an actuating operation;

moving a sleeve within the actuator to maintain alignment between a piston head within the actuator and a sleeve aperture of the sleeve;

hydraulically connecting a low pressure cavity defined by the sleeve to one of a retract cavity or an extend cavity of the actuator when the piston head is offset from the sleeve aperture; and moving the piston head into alignment with the sleeve aperture in response to the connection between the low pressure cavity and the one of the retract cavity or the extend cavity.

11. The method of claim 10, further comprising monitoring a position of at least one of the piston head or the piston within a housing of the actuator.

12. The method of claim 10, wherein moving of the sleeve is controlled by a motor operably coupled thereto.

13. The method of claim 10, further comprising:

detecting a position of piston head within the actuator; and controlling the position of the sleeve aperture to maintain alignment of the sleeve aperture and the piston head in response to the detected position.

14. The method of claim 10, wherein movement of the piston head to align with the sleeve aperture is in response to a power failure of the actuator.

15. The method of claim 10, wherein the low pressure cavity has a lower pressure than a pressure of the retract cavity or the extend cavity.

16. The method of claim 10, further comprising:

supplying the retract cavity with a high pressure from a first high pressure source;

supplying the extend cavity with a high pressure from a second high pressure source; and supplying the low pressure cavity with a low pressure from a low pressure source, wherein the low pressure is less than the pressure of either of the first and second high pressure sources.

* * * * *